US007467942B2

(12) United States Patent
Carroni et al.

(10) Patent No.: US 7,467,942 B2
(45) Date of Patent: Dec. 23, 2008

(54) DEVICE AND METHOD FOR FLAME STABILIZATION IN A BURNER

(75) Inventors: Richard Carroni, Niederrohrdorf (CH); Thiemo Meeuwissen, Baden (CH)

(73) Assignee: ALSTOM Technology Ltd., Baden (CH)

( * ) Notice: Subject to any disclaimer, the term of this patent is extended or adjusted under 35 U.S.C. 154(b) by 168 days.

(21) Appl. No.: 11/533,828

(22) Filed: Sep. 21, 2006

(65) Prior Publication Data

US 2007/0042301 A1 Feb. 22, 2007

Related U.S. Application Data

(63) Continuation of application No. PCT/EP2005/051333, filed on Mar. 23, 2005.

(30) Foreign Application Priority Data

Mar. 30, 2004 (DE) ..... 10 2004 015 607

(51) Int. Cl.
*F23D 3/40* (2006.01)

(52) U.S. Cl. ..... 431/7; 431/10; 431/12; 431/350; 431/353; 431/328; 431/170; 431/326

(58) Field of Classification Search ..... 431/7, 431/10, 12, 170, 326, 187, 183, 350, 353, 431/328
See application file for complete search history.

(56) References Cited

U.S. PATENT DOCUMENTS

| | | | | |
|---|---|---|---|---|
| 4,459,126 | A | 7/1984 | Krill et al. | |
| 5,569,020 | A | 10/1996 | Griffin et al. | |
| 5,626,017 | A * | 5/1997 | Sattelmayer | 60/723 |
| 5,937,632 | A | 8/1999 | Dobbeling et al. | |
| 6,358,040 | B1 | 3/2002 | Pfefferle et al. | |
| 6,394,791 | B2 | 5/2002 | Smith et al. | |

FOREIGN PATENT DOCUMENTS

| | | |
|---|---|---|
| EP | 0321809 | 6/1989 |

(Continued)

OTHER PUBLICATIONS

Nguyen, O., et al., "The Effect of Discrete Pilot Hydrogen Dopant Injection on the Lean Blowout Performance of a Model Gas Turbine Combustor," Presented at the International Gas Turbine & Aeroengine Congress & Exhibition, Jun. 7-10, 1999, pp. 1-6, The American Society of Mechnical Engineers, New York, NY, USA.

(Continued)

*Primary Examiner*—Alfred Basichas
(74) *Attorney, Agent, or Firm*—Cermak Kenealy & Vaidya LLP; Adam J. Cermak

(57) ABSTRACT

A device and a method for flame stabilization in a burner (10), includes a burner housing at least partially enclosing a burner volume, into which may be introduced via at least one fuel line, fuel, and via at least one air feed means, air, forming an air/fuel mixture spreading in a preferred flow direction, which may be ignited in a combustion chamber (11) connecting downstream of the burner housing to form a stationary flame (13). Upstream of the flame (13), a catalyst arrangement (1) is provided through which an air/pilot fuel mixture (4), separate from the air/fuel mixture, is flowable. The catalyst arrangement (1) has at least two catalyst stages which are located one behind the other in the through-flow direction, of which the catalyst stage (3) located upstream, the so-called POX-catalyst, is flow-washable by the air/pilot fuel mixture (4) with an air/pilot fuel mixture ratio $\lambda<1$, by which catalyst stage (3) the air/pilot fuel mixture (4) is partially oxidized, and of which catalyst stages the downstream catalyst stage (8), the so-called FOX-catalyst, is flow-washable by a leaned air/pilot fuel mixture (7) with a mixture ratio $\lambda>1$, by which the leaned air/pilot fuel mixture is completely oxidized forming an inert hot gas flow (9).

16 Claims, 4 Drawing Sheets

FOREIGN PATENT DOCUMENTS

| | | |
|---|---|---|
| EP | 0694740 | 1/1996 |
| WO | WO93/25852 | 12/1993 |
| WO | WO03/072919 | 9/2003 |
| WO | WO2004/020905 | 3/2004 |
| WO | WO2004/094909 | 11/2004 |
| WO | WO2005/095855 | 10/2005 |

OTHER PUBLICATIONS

Search Report for German Patent App. No. 10 2004 041 794.6 (Aug. 30, 2004).
International Search Report for PCT Patent App. No. PCT/EP2005/051333 (Jul. 25, 2005).
International Examination Report for PCT Patent App. No. PCT/EP2005/051333 (Jun. 16, 2006).

* cited by examiner

DEVICE AND METHOD FOR FLAME STABILIZATION IN A BURNER

This application is a Continuation of, and claims priority under 35 U.S.C. § 120 to, International application number PCT/EP2005/051333, filed 23 Mar. 2005, and claims priority under 35 U.S.C. § 119 to German application number 10 2004 015 607.7, filed 30 Mar. 2004, the entireties of both of which are incorporated by reference herein.

BACKGROUND OF THE INVENTION

1. Field of the Invention

The invention refers to a device for flame stabilization in a burner, with a burner housing at least partially enclosing a burner volume into which may be introduced via at least one fuel line, fuel, and via at least one air feed means, air, forming an air/fuel mixture spreading in a preferred flow direction, which air/fuel mixture may be ignited in a combustion chamber connecting downstream of the burner housing to form a stationary flame. In addition, a method for flame stabilization in a burner related to this is described.

2. Brief Description of the Related Art

Modern premix burners, as a representative of which example reference is made to a premix burner with a conical burner housing, which is described in EP 321 809 B1, are optimized from the point of view of their efficiency as well as with regard to their pollutant emissions. The optimizations carried out on the burner systems are valid especially for load ranges in which such burner systems are mainly operated in order to drive, for example, heat engines, mainly gas- or steam turbine installations. Such installations are operated for most of the time under full- or partial load conditions.

From the aforementioned example of a conically constructed premix burner, attention should be drawn subsequently to a problem which arises during the operation of such burners. The embodiments mentioned below are not necessarily limited to conical premix burners. On the contrary, the problem relates to all generic premix burners.

In a manner known per se, modern premix burners include conically widening burner volumes, the so-called swirl chamber, into which air and fuel are fed forming a swirled flow conically widening axially in the direction of the swirl chamber. By the provision of an inconstant flow transition between the swirl chamber and the combustion chamber housing connecting to the swirl chamber, the swirled flow splits and forms inside the combustion chamber a reverse flow zone in which the fuel mixture ignites forming a spatially largely stationary flame. In order to be able to ensure a combustion process which is as optimized as possible, it is necessary to promote flame development which is as homogenous and spatially stationary as possible.

Such burners are, however, unavoidable if operated even only temporarily under load- and operating conditions, under which a homogenously developing, spatially stationary flame cannot be formed or can be formed only with considerable limitations. Especially under start- and low load conditions, corresponding measures for flame stabilization have to be taken to ensure the demands made for the flame quality. A tried and tested apparatus for flame stabilization constitutes the so-called pilot gas feed by which the added pilot gas which experiences no premixing or only slight premixing with the feed air is fed to the flame mostly via a burner lance installed centrally in the burner. Such pilot gas feeds lead to so-called pilot flames which are basically of the diffusion type, even in cases in which the premix burner is operated under lean fuel conditions.

A further measure for flame stabilization provides for the use of catalysts which, within the scope of a so-called catalytic piloting, are provided in the mixing region of a premix burner, and, depending on the air/fuel ratio $\lambda$ and also on the oxygen present in the mixture, oxidize at least portions of the fuel contained in the air/fuel mixture. It is possible, by use of catalytic reactors inside the premix burner region, to produce by partial oxidation of the fuel portion so-called syngas which consists of $H_2$ and CO and, on the basis of the hydrogen content, constitutes a highly reactive gas, especially in the case of a rich air/fuel mixture, i.e., $\lambda<1$. In this way it was able to be experimentally proved that a specific admixing of syngas into the flame region developing in the combustion chamber, an improved combustion stability with regard to a stable flame position, and also a reduced nitrogen monoxide emission can be achieved (see Samuelsen, 99-GT-359, ASMA-Turbo Indianapolis).

It is also known to create, by catalytic partial oxidation, an air/fuel mixture developing inside a burner, and to create, by suitable selection of the air/fuel ratio and inlet temperatures of the air/fuel mixture in the catalytic reactor, a syngas-free gas mixture consisting of $CH_4$, $N_2$, $CO_2$, and $H_2O$ which, on account of the methane contained in the gas mixture, corresponds to a conventional, lean, premixed pilot gas. Such a method is to be gathered from U.S. Pat. No. 6,358,040 and also U.S. Pat. No. 6,394,791, for example. A method can be taken in each case from these publications in which the air/fuel mixture partially oxidized by way of catalysis is mixed with cooling air in order to avoid spontaneous ignitions and a diffusion flame connected with it and to be ultimately fed as a hot, lean, $CH_4$-containing mixture for the purpose of the stabilization of the flame homogenously developing inside the combustion chamber.

All three previously described measures, be it the feed of pilot gas forming a diffusion flame or the use of catalytic reactors for producing syngas-containing or syngas-free, but in any case $CH_4$-containing, gas mixtures, are based on the mixing of a hot, reactive pilot gas with the air/fuel mixture developing in the premix burner. In all cases it is consequently crucial that a complete mixing of the reactive pilot gas with the air/fuel mixture is produced before spontaneous ignitions occur in order to ultimately avoid so-called hotspots and also increased nitrogen oxide emissions. By the additional feed of a reactive pilot gas, the flame position, moreover, can change inside the combustion chamber, which causes a reduction in the time span of the complete mixture formation, especially in that case in which the flame assumes a combustion chamber-internal upstream orientated position. Obviously, an increased formation and emission of nitrogen oxides is associated therewith.

The influence on the spatial position of the homogenous flame developing inside the combustion chamber is, by means of a pilot gas feed, greater the richer in fuel the supplied pilot gas is. The place of the feed of syngas relative to the flame position is of significant importance, in particular during the possible syngas formation by way of the catalytically promoted partial oxidation, especially since the flame position could react very sensitively with regard to a syngas feed. These dependencies of the flame position associated with syngas feed are explained in detail in U.S. Pat. No. 5,937,632 and described within the scope of a so-called chemical flame stabilization.

To sum up, it can consequently be emphasized that problems face the previously described measures for flame stabilization during the operation of modern premix burners, especially under partial load conditions or during the starting phase.

It is necessary on the one hand to avoid the formation of so-called hot pockets, i.e., unburnt fuel, which reacts with the air/fuel mixture of the main flow before the mixture has experienced complete mixing. On the other hand, the piloting technique previously in use influences the flame position and thus the available time for the complete mixing of the air/fuel mixture which with premature ignition releases a considerable nitrogen oxide portion.

SUMMARY OF THE INVENTION

One aspect of the present invention includes a device and a method for flame stabilization of a flame developing downstream of a premix burner in such a way that the measures used for the stabilization are neither capable of lastingly impairing the flame stability, i.e., the flame location, nor of leading to an increased nitrogen oxide emission. On the contrary, it should be possible to take flame-stabilizing measures which in the main do not depend on burner design and do not lastingly impair the combustion characteristics optimized by the burner concept. Therefore, the measures to be taken are to help to create an increased design flexibility in the construction of premix burners and, moreover, be applicable to as many different burner systems as possible without having to take into account requirements with regard to a special system optimization.

Features advantageously developing principles of the present invention are subject matter of the following description, especially with reference to the exemplary embodiments described below.

In another aspect of the present invention, a device for flame stabilization in a burner is constructed in such a way that upstream of the flame is provided a catalyst arrangement through which flows an air/pilot fuel mixture separate from the air/fuel mixture (4). The catalyst arrangement has at least two catalyst stages which are installed one behind the other in the flow direction of the air/fuel mixture developing inside the burner, of which catalyst stages the catalyst stage located upstream, the so-called POX-catalyst, is flow-washed by an air/pilot fuel mixture with a mixture ratio $\lambda<1$ by which catalyst stage the air/pilot fuel mixture is partially oxidized. The catalyst stage downstream in the through-flow direction, the so-called FOX-catalyst, is flow-washed by a leaned air/pilot fuel mixture with a mixture ratio $\lambda>1$ by which catalyst stage the leaned air/pilot fuel mixture is completely oxidized forming an inert hot gas flow.

A method principle forming a basis of the device embodying principles of the present invention is based on a flame stabilization with the aid of a chemically inert hot gas flow of at least 600° C., and preferably up to 950° C., which is introduced into the combustion chamber in or adjacent to the flame. The hot, non-reacting gas brings about a thermal stabilization of the homogenized flame developing inside the combustion chamber, wherein the inert nature of the hot, hot gas components makes it possible to feed the inert hot gas flow at any point inside the burner system to that in the flame region without, as a consequence, altering the flame position and the mixing times associated with it, nor giving rise to increased nitrogen oxide formation. By such exemplary measures, an unprecedented degree of design flexibility is created which allows a device constructed according to principles of the present invention, which has a so-called two-stage pilot catalyst, to be combined with the most varied burner systems, largely without, as a consequence, having to take into account optimization requirements which would be bound by special system constraints.

The catalyst arrangement constructed in two stages is capable by its first catalyst stage, the POX-catalyst, of catalysing a fuel-rich, i.e., rich air/pilot fuel mixture with an air/pilot fuel ratio $\lambda<1$, in such a way that, downstream of the POX-catalyst, a partially oxidized air/pilot fuel mixture issues from the POX-catalyst. By means of a corresponding air feed, the partially oxidized air/pilot fuel mixture is mixed downstream of the POX-catalyst with feed air for forming a leaned air/pilot fuel mixture, i.e., $\lambda>1$, prior to entry into the FOX-catalyst inside which the leaned air/pilot fuel mixture is completely oxidized. Finally, after passage through the whole catalyst arrangement, a hot gas which is very hot and chemically inert as a result of the exothermal oxidation reactions is formed which, for the specific thermal flame stabilization, is fed into the region of the combustion chamber in which the flame forms.

BRIEF DESCRIPTION OF THE DRAWINGS

The invention is hereinafter described by way of example without limitation of the general idea of the invention from exemplary embodiments with reference to the drawings.

In the drawings.

DETAILED DESCRIPTION OF EXEMPLARY EMBODIMENTS

Figure 1:
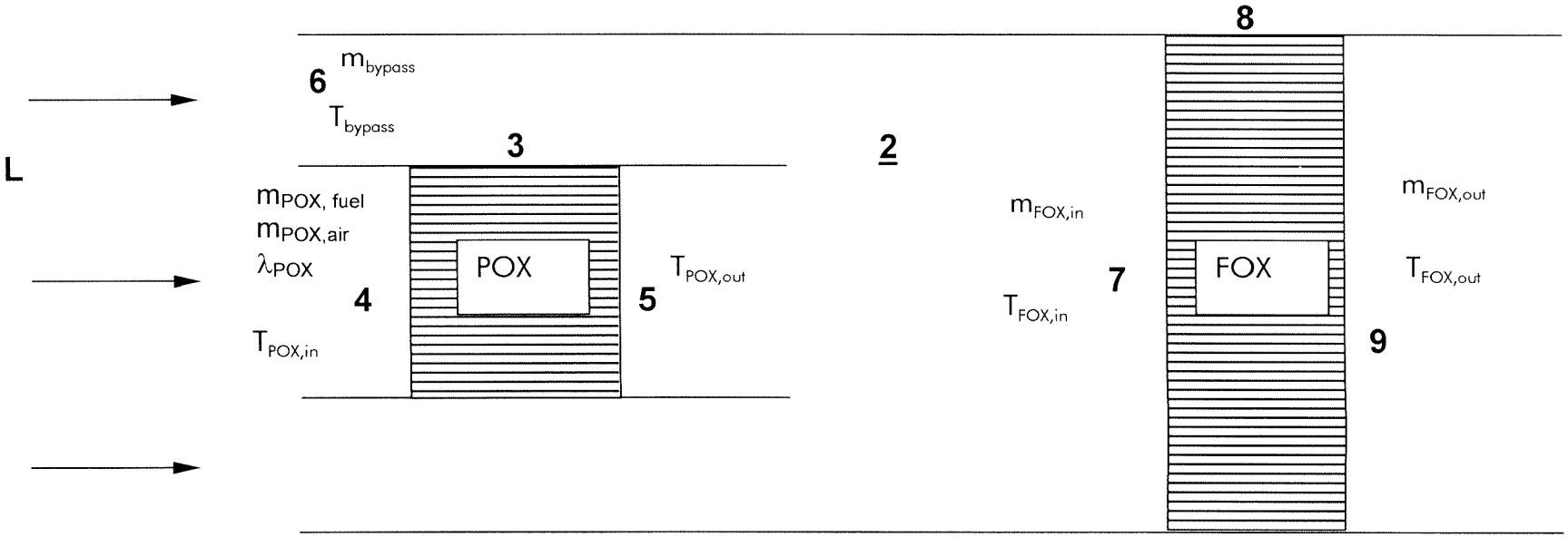
FIG. 1 shows a schematized view of the two-stage catalyst arrangement.

The schematized view represented in FIG. 1 shows a catalyst arrangement 1 embodying principles of the present invention which includes a flow passage 2 through which passes an air flow L from left to right in the drawing. Provided inside the catalyst arrangement centrally upstream of the flow passage 2 is a first catalyst 3, the so-called POX-catalyst, which has a plurality of catalyst passages orientated in the flow direction and which are lined on the inner wall with suitably selected catalyst material and is specially selected for the catalysis of a rich air/pilot fuel mixture. The POX-catalyst 3 on the upstream side is fed by an air/pilot fuel mixture 4, which consists of a completely mixed fuel flow $m_{POX,fuel}$ and an air flow $m_{POX,air}$. The air/pilot fuel mixture 4 entering the POX-catalyst 3 is provided with an adjustable mixture ratio $\lambda_{POX}$ as well as a specifically adjustable mixture inlet temperature $T_{POX,in}$. Because, as already mentioned, the flow passages of the POX-catalyst 3 are coated with a catalytic layer of suitable selection, preferably with rhodium or a material compound containing rhodium, and have corresponding flow geometries, any overheating of the passage walls by the catalytically promoted, exothermally acting partial oxidation of the fuel contained in the air/pilot fuel mixture 4 is avoided. At the same time, the POX-catalyst 3 ensures a homogenously throughly mixed outlet mixture 5, the temperature $T_{POX,out}$ of which depends on one hand upon the inlet temperature $T_{POX,in}$ and also on the air/pilot fuel mixture ratio $\lambda_{POX}$. In a preferred embodiment, the outlet temperature $T_{POX,out}$ of the outlet mixture 5 is in a range between 600° C. and 950° C., wherein the outlet mixture 5 consists predominantly of $CH_4$, $N_2$, $CO_2$ and $H_2O$. Furthermore, the outlet mixture 5 has only a small portion of the previously described syngas, preferably with volume percentages below 5%. In the same way, oxygen portions $O_2$ with a volume percentage of <5% can be contained in the outlet mixture 5. In the previously described exemplary embodiment, the air/pilot fuel mixture 4 fed to the POX-catalyst 3 has an air/fuel ratio $\lambda_{POX,in}$ of typically between 0.15 and 0.4, i.e. the air/pilot fuel mixture fed to the POX-catalyst 3 is comparatively high in fuel, or rich.

Downstream of the POX-catalyst 3, a predetermined volume of air L bypassing the POX-catalyst 3 is added to the outlet mixture 5, with a specifically adjustable mass flow 6 $m_{bypass}$ as well as a predeterminable air temperature $T_{bypass}$ which is identical to or similar to the inlet temperature $T_{POX,in}$ of the air/pilot fuel mixture 4 fed to the POX-catalyst 3. Downstream of the POX-catalyst 3, therefore, a mixture forms which is very much leaned, typically with an air/pilot fuel ratio of $4<\lambda<9$. The air/pilot fuel mixture 7 leaned in this way, with a suitably dimensioned mass flow $m_{POX,in}$ is fed to the so-called FOX-catalyst 8 installed downstream in the flow direction through the catalyst arrangement 1, wherein the leaned air/pilot fuel mixture 7 has a temperature $T_{FOX,in}$ which is smaller than $T_{POX,out}$.

With regard to the temperature $T_{POX,out}$ of the outlet mixture 5, attention is to be paid to ensuring that it is low enough to be able to reliably exclude possible spontaneous ignitions during the mixing of the feed air L with the partially oxidized air/pilot fuel mixture 5 issuing from the POX-catalyst 3. This process is assisted in that a high degree of equal distribution inside the outlet mixture 5 is created by the provision of corresponding passage guides in the POX-catalyst 3, by means of which so-called fuel pockets can be excluded. In addition, the partial oxidation taking place inside the POX-catalyst 3 ensures a largely complete depletion of the mass flow of oxygen. The temperature $T_{FOX,in}$ moves typically in the range between 500° C. and 950° C. and depends especially on the temperature $T_{POX,out}$ of the outlet mixture 5 as well as on the volume of the bypass air $m_{bypass}$ supplied. $T_{FOX,in}$ should at any time be greater than the light-off temperature of the FOX-catalyst 8 so that it is ensured that the leaned air/pilot fuel mixture entering the FOX-catalyst 8 is completely catalytically oxidized.

In the region between the POX-catalyst 3 and the FOX-catalyst 8, for the complete mixing and development of a leaned air/pilot fuel mixture, additional turbulence-producing means, such as venturi arrangements or similar devices, can advantageously be provided to promote the mixing process.

Also, the FOX-catalyst 8 is lined on the inner wall with suitable catalyst material, for example Pd or Pt, by means of which it can be ensured that the leaned air/pilot fuel mixture 7 passing through the FOX-catalyst 8 is completely oxidized, so that any fuel present in the mixture 7 is converted into $CO_2$ and $H_2O$. The gas mixture $M_{FOX,out}$ issuing from the catalyst arrangement 1 has, therefore, a very high temperature, typically $T_{FOX,out}$, of up to 950° C. and contains mainly $CO_2$, $H_2O$, $O_2$ and $N_2$. Only very small portions of $CH_4$ can also be contained which, however, are not capable of impairing the chemically inert character of the outlet gas 9.

The FOX-catalyst 8 lined on the inner wall side preferably with platinum or palladium is capable of achieving the adiabatic process temperatures of the gas mixture passing through the catalyst without as a consequence succumbing to material overheating itself, since the gas mixture passing through the FOX-catalyst 8 is very much leaned and the adiabatic temperatures associated with it lie far below the material-specific maximum temperatures.

It would certainly be possible to direct fuel-richer mixtures through the FOX-catalyst 8 but in this case an additional cooling measure on the FOX-catalyst 8 would have to be provided, such as, for example, an additional catalyst cooling by means of bypass air or by a corresponding selection of high temperature-resistant catalyst materials. Furthermore, a coating of the catalyst passages provided only partially with catalyst material could lead to improved temperature control inside the FOX-catalyst, but these measures would on the other hand lead to an increased portion of $CH_4$ in the exhaust gas flow 9, which could lead to the desired chemical inert character of the exhaust gas flow 9 being impaired.

With the aid of the previously described catalyst arrangement, it is possible to create a hot, inert gas flow and to use it for the thermal stabilization of a homogenized flame developing inside the combustion chamber. The inert character of the gas flow allows the gas flow to be injected at any location in the burner or in the combustion chamber without as a consequence suffering lasting repercussions inside the mixture formation developing in the burner. Similarly, the feed according to the invention of a hot inert gas flow into the burner region has no influences on the spontaneous ignition behavior and the nitrogen oxide formation. Special attention, however, is paid to the thermal stabilization of the homogenized flame inside the combustion chamber proposed according to the invention by the fact that the flame location remains unaltered despite hot gas feed, as a result of which a flame shift upstream inside the burner is avoided. As a result, the mixing times and the nitrogen oxide emission associated therewith are in no way influenced. This creates an improved design flexibility compared with the piloting methods hitherto known and in use.

Particularly advantageous is the use of the device constructed according to principles of the present invention for flame stabilization in burner systems for the firing of gas turbine installations in which high firing temperatures predominate and spontaneous ignitions of air/fuel mixtures are very much more likely to occur. In such heavy duty turbine installations, the use of hitherto known piloting methods associated with the disadvantages explained at the outset with regard to flame migration and nitrogen oxide formation is made difficult. Methods according to the invention can be used uninterrupted independently of the burner load, especially also under full load conditions, even if the flow rate were to be reduced. In this way, costly purgings of fuel passages, as are used in hitherto conventional pilot gas feeds for avoiding backfires in the fuel line, can advantageously be completely dispensed with, so that the additional associated purging cost ceases to apply.

By the provision of a POX-catalyst 3 with a low light-off temperature, the catalyst arrangement can be efficiently used during the whole load range of the burner for the firing of, for example, a gas turbine installation, i.e. from starting up to full load. Thus, it is especially advantageous during the starting up of a gas turbine to preheat the air/pilot fuel mixture 4 entering the POX-catalyst 3, with the aid, for example, of an electric preheater which brings the mixture $m_{POX,air}+m_{POX,fuel}$ to the ignition temperature of the POX-catalyst 3. If the catalyst is first heated during the start conditions, then the electric preheater can be turned off. Because of the inert temperature behavior of the POX-catalyst it is possible especially in the aforementioned case of the running-up of a gas turbine to effectively catalyse air/pilot fuel mixtures beforehand with temperatures $T_{POX,in}$, although $T_{POX,in}$ can be up to 200° C. less than the light-off temperature of the catalyst itself. It is also possible, especially under start conditions, to correspondingly vary and set the air/pilot fuel ratio $\lambda_{POX}$ by corresponding variation of the fuel rate $m_{POX,fuel}$ or of the air flow rate $m_{POX,air}$.

Figure 2:
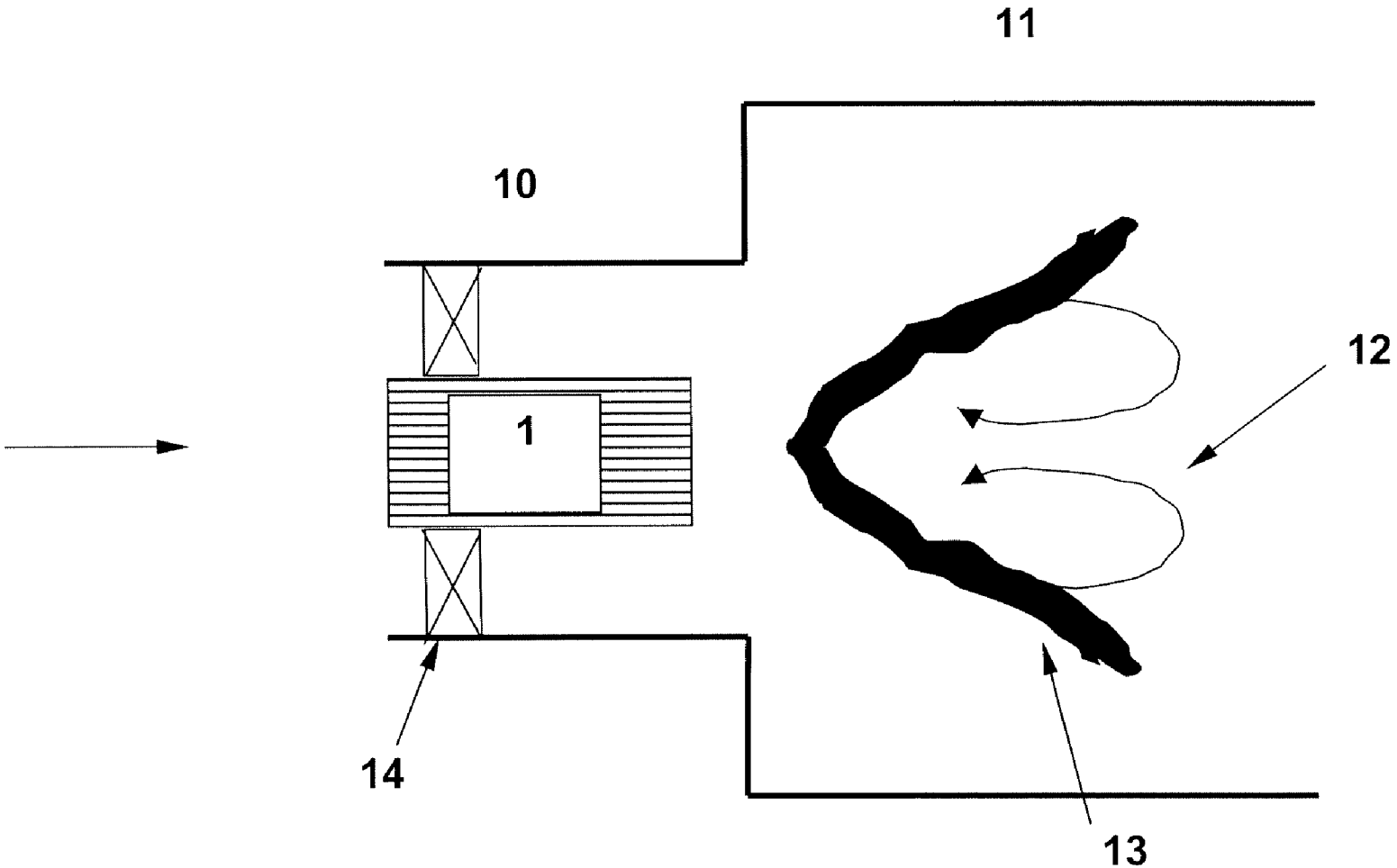
FIG. 2 shows a schematized view of the catalyst arrangement inside a burner system.

FIG. 2 shows a schematized view of a preferred arrangement possibility of the catalyst arrangement 1 inside a burner 10 which is constructed preferably as a premix burner and which according to the arrow representation in the flow direction is flow-washed by an air/fuel mixture developing inside the burner 10. Inside the premix burner 10, a swirled flow D developing in the flow direction is formed as a result of flow-dynamic basic conditions, by the application of a swirler, for example, which, on account of the inconstant flow cross-sectional area widening between the premix burner 10 and combustion chamber 11, splits and forms a reverse flow zone 12 in which a homogenous flame 13 forms spatially stationary.

The catalyst arrangement 1 in the exemplary embodiment shown is installed centrally within the flow ratio in the premix burner 10. For the complete mixing of the air/fuel mixture establishing itself inside the premix burner and also for the stabilization of the flame, additional swirlers or vortex generators 14 are provided which radially encompass the catalyst arrangement 1.

Naturally, it is also possible to position the catalyst arrangement 1 in another area located inside the premix burner 10. It is to be furthermore gathered from the exemplary embodiment shown in FIG. 2 that a separate air/pilot fuel mixture (4) is fed to the catalyst arrangement 1 for forming the hot, inert hot gas flow separately from the fuel/air supply of the burner. The air/fuel mixture flowing around the catalyst arrangement 1 is caused to ignite in the combustion chamber 11 forming a homogenous flame 13.

Figure 3:
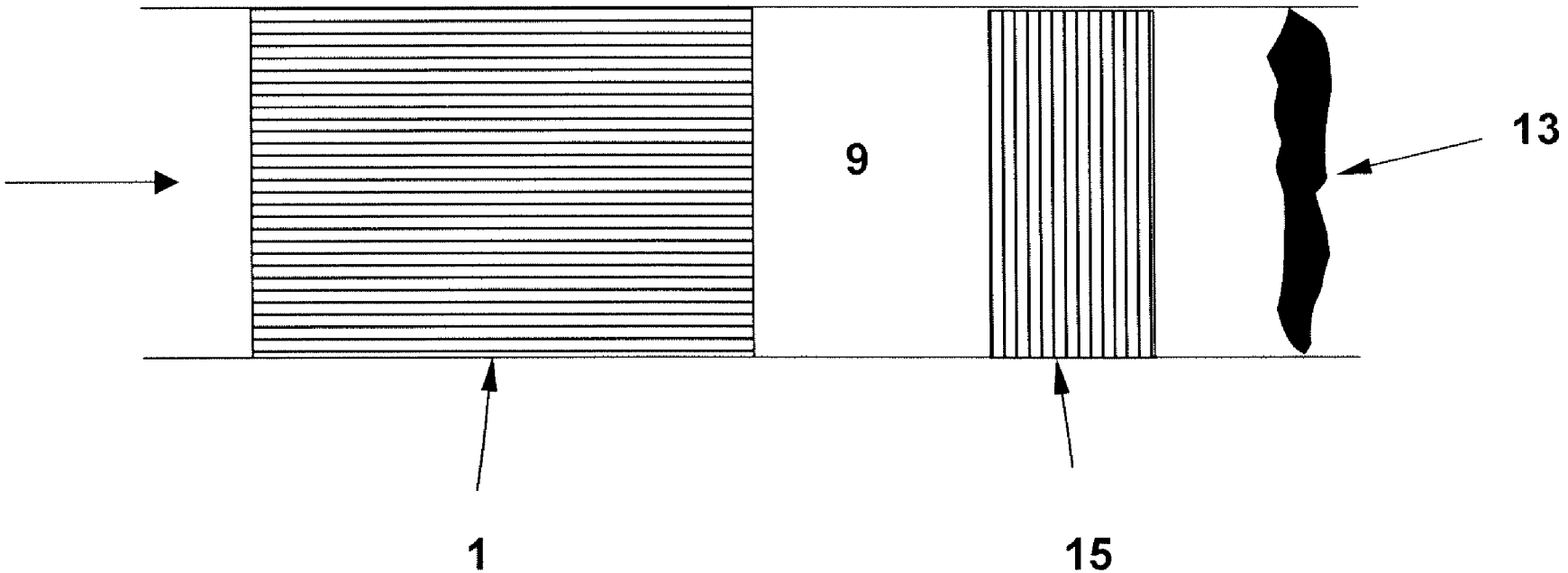
FIG. 3 shows a schematized view of a catalyst arrangement inside a two-stage burner arrangement and FIG. 4 shows a schematized view of a catalyst arrangement for the realization of a changeover between chemical and thermal flame stabilization.

FIG. 3 shows a further possibility for the use of the catalyst arrangement 1 embodying principles of the present invention. Here, it may be assumed that the catalyst arrangement 1, as is to be gathered in detail from the previously described FIG. 1, is used as a first burner stage inside a two-stage burner arrangement. The catalyst stage 1 is therein flow-washed by the whole air/fuel mixture which is guided through the burner arrangement and forms downstream of the catalyst arrangement 1 a chemically inert hot gas 9 which is fed directly to a second burner stage 15 in which additional fuel and also bypass air is added to the inert chemical hot gas. The hot gas/fuel mixture forming on this occasion ignites ultimately in the form of a homogenous flame 13 downstream of the second burner stage 15.

A preferred exemplary embodiment for a possible design of the POX-catalyst 3 provides for a plurality of flow passages passing through the catalyst 3 which are divided into two groups. Thus, the air/pilot fuel mixture 4 is directed through a first group of flow passages which are coated on the inner walls with catalyst material, preferably with rhodium. Separately from this, the second group of flow passages passing through the POX-catalyst 3, which do not necessarily have to be coated with catalyst material, are flow-washed by air. The advantage of such an embodiment lies in an improved mixing of the outlet flows and enables, moreover, an improved control of the POX-catalyst temperature Tpox, since the flow rates of both flow portions can be variably adjusted separately from one another, and the feed air serves for a concentrated cooling of the POX-catalyst 3.

Figure 4:
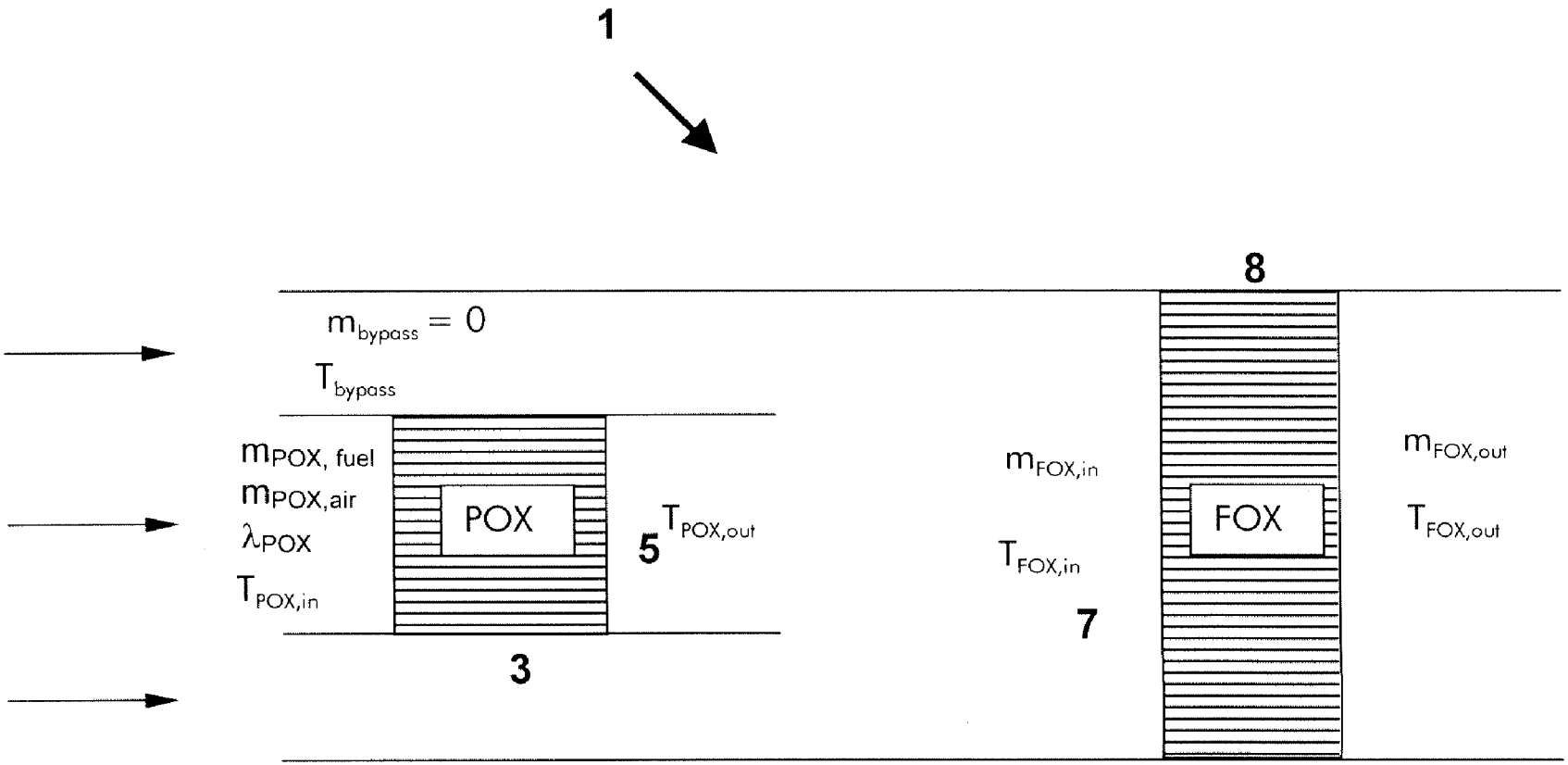

FIG. 4 shows a catalyst arrangement 1 comparable to that shown in FIG. 1, with a POX-catalyst 3 and a FOX-catalyst 8 provided along a flow passage 2. Basically, it is possible to modify the operating concept on which aspects of the invention are based in such a way that the manufacture of a hot gas containing, highly reactive syngas becomes possible. The production of a hot gas containing highlyreactive syngas could be advantageous especially for difficult operating situations during the activating process of the burner and also under very low load conditions. In order to produce such a hot gas containing syngas of this type, contrary to the situation described in FIG. 1, no feed air L, i.e. $m_{bypass}=0$, is admixed. Therefore, the outlet mixture 5 issuing from the POX-catalyst 3 experiences no leaning. The air/pilot fuel ratio fed to the POX-catalyst 3 is typically selected so that syngas production is promoted. Typically, the air/pilot fuel ratio comes to a value of $\lambda_{POX}>0.25$. As the outlet mixture 5 issuing from the POX-catalyst 3 contains no portions or only small portions of oxygen, typically <3%, only a limited oxidation reaction takes place in the subsequent FOX-catalyst 8 on account of the lack of oxygen. Therefore, the reactive hot gases required for flame stabilization are formed principally in the POX-catalyst 3.

Problematical with such an operating method is, however, the changing over from the previously described syngas producing mode to the standard scenario according to the invention in which, with the aid of the catalyst arrangement, exclusively hot inert gases are formed. Problematical, based on the syngas producing mode, in which $m_{bypass}=0$, is an admixture ratio of bypass air, in which the air/fuel mixture 7 flowing into the FOX-catalyst 8 has a stoichiometric ratio, at which extreme overheating inside the FOX-catalyst 8 can occur which may lead to irreparable damage.

To avoid this, the following method technique is proposed: in the case of low load. i.e. in the syngas producing mode, in which $m_{bypass}=0$ and typically $0.25<\lambda_{POX}<0.6$ prevails, it is necessary to take into account the following. During the transition to the standard scenario according to the invention, it is necessary to take into account two measures at the same time. A little more fuel is added to the air/fuel mixture developing inside the burner, which, for the ignition inside the combustion chamber forms a homogenous flame, making sure that the flame is not blown out. At the same time the air/pilot fuel ratio $\lambda_{POX}$ of the air/pilot fuel mixture 4 fed to the POX-catalyst 3 is reduced to a value <0.15, while either the mass flow $m_{POX,fuel}$ is increased or the air feed flow $m_{POX,air}$ is reduced. The richer air/pilot fuel mixture 4 ensuing from this, entering the POX-catalyst 3, has a lower adiabatic temperature at which no syngas production takes place. Consequently, the outlet temperature $T_{POX,out}$ drops to a value between 500° C. and 700° C. As soon as the bypass air $m_{bypass}$ is added, the inlet temperature $T_{FOX,in}$ falls far below the value of the outlet temperature $T_{POX,out}$ and assumes temperatures of very much less than 600° C. Hence, the flow rates $m_{POX,fuel}$, $m_{POX,air}$ and also $m_{bypass}$ and $m_{FOX,in}$ resulting from it, the $T_{POX,out}$ and $T_{FOX,in}$ are below the spontaneous ignition threshold of a stoichiometric air/fuel mixture, wherein $T_{FOX,in}$ is less than the light-off temperature of the FOX-catalyst 8. For this reason, no spontaneous ignition occurs and the FOX-catalyst 8 suffers no overheating, although the outlet mixture 5 of the POX-catalyst 3 in mixture with the feed air $m_{bypass}$ for a short period of time represents a stoichiometric mixture. The amount of $m_{bypass}$ is then continuously increased so that the air/pilot fuel ratio of the mixture 7 $\lambda_{FOX,in}$ entering the FOX-catalyst 8 is $\geqq 1$, and likewise $\lambda_{POX,in}$ can be similarly increased until the full load range is reached and the catalyst arrangement produces exclusively chemically inert hot gases.

| List of Designations | |
|---|---|
| 1 | Catalyst arrangement |
| 2 | Flow passage |
| 3 | POX-catalyst |
| 4 | Inlet air/pilot fuel mixture in the POX-catalyst |
| 5 | Outlet mixture |
| 6 | Bypass mass flow |
| 7 | Inlet air/fuel mixture in the FOX-catalyst |
| 8 | FOX-catalyst |
| 9 | Chemically inert hot gases |
| 10 | Burner |
| 11 | Combustion chamber |
| 12 | Reverse flow zone |
| 13 | Homogenous flame |
| 14 | Vortex generator |
| 15 | Second burner stage |
| D | Swirled flow |
| L | Feed air |
| F | Fuel |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A burner comprising:

a burner housing;

a burner volume at least partially enclosed by the burner housing into which burner volume fuel can be introduced via at least one fuel line, and into which burner volume air can be introduced via at least one air feed means, the fuel and air forming an air/fuel mixture spreading in a preferred flow direction;

a combustion chamber connected downstream of the burner housing in fluid communication with the burner volume, configured and arranged to form a stationary flame of the air/fuel mixture; and a flame stabilization device comprising a catalyst arrangement positioned upstream of the flame configured and arranged for an air/pilot fuel mixture, separate from said air/fuel mixture, to flow through, said catalyst arrangement including at least two catalyst stages which are located one behind the other in a though-flow direction, the at least two catalyst stages including an upstream catalyst stage comprising a POX-catalyst which is flow-washable by an air/pilot fuel mixture having an air/pilot fuel mixture ratio $\lambda<1$, by which upstream catalyst stage the air/pilot fuel mixture is partially oxidized when flowing therethough, and a downstream catalyst stage comprising a FOX-catalyst which is flow-washable by a leaned air/pilot fuel mixture with a mixture ratio $\lambda>1$, by which downstream catalyst stage the leaned air/pilot fuel mixture is completely oxidized when flowing therethough, forming an inert hot gas flow;

wherein the air/pilot fuel mixture fed to the catalyst arrangement can be fed separately from the air/fuel mixture developing inside the burner volume, which air/fuel mixture inside the burner volume is to be ignited in the combustion chamber.

2. The burner as claimed in claim 1, further comprising:

an air feed between the POX- and FOX-catalysts by which feed air can be added to the partially oxidized air/pilot fuel mixture issuing from the POX-catalyst in such a way that, before entry into the FOX-catalyst, the leaned air/pilot fuel mixture is formed.

3. The burner as claimed in claim 1, further comprising:

flow turbulence producing means positioned upstream of the FOX-catalyst for completely mixing-through the leaned air/pilot fuel mixture.

4. The burner as claimed in claim 1, further comprising:

a fuel feed downstream of or parallel to the catalyst arrangement by which fuel feed fuel can be added to the hot gas flow issuing from the catalyst arrangement.

5. The burner as claimed in claim 4, wherein the fuel feed comprises an air/fuel mixture.

6. A method for the stabilization of a homogenous flame developing inside a combustion chamber fired by a burner, the method comprising:

providing a burner according to claim 1; and stabilizing the flame thermally or chemically, including feeding a hot gas containing syngas comprising $H_2$ and CO from said burner, depending on the burner load.

7. The method as claimed in claim 6, further comprising:

under start conditions or low load conditions, chemically stabilizing the flame including feeding a partially oxidized air/pilot fuel mixture issuing directly from the POX-catalyst to the FOX-catalyst without leaning; and under normal- or high load conditions, thermally stabilizing the flame including leaning a partially oxidized air/pilot fuel mixture issuing from the POX-catalyst before entry into the FOX-catalyst.

8. The burner as claimed in claim 1, wherein the burner comprises a premix burner.

9. The burner as claimed in claim 8, further comprising:

a mixing tube and the combustion chamber; and wherein the premix burner comprises a premix burner housing to which in the flow direction the combustion chamber is connected separately by the mixing tube; and wherein the catalyser arrangement is positioned inside the burner volume, enclosed by the premix burner or by the mixing tube.

10. The burner as claimed in claim 9, wherein the premix burner housing conically widens in the flow direction.

11. A method for flame stabilization in a burner, the burner including a burner housing at least partially enclosing a burner volume, the method comprising:

introducing fuel into the burner volume via at least one fuel line;

introducing air into the burner volume via at least one air feed means, the fuel and air forming an air/fuel mixture spreading in a preferred flow direction;

igniting the air/fuel mixture in a combustion chamber connecting downstream of the burner housing, forming a stationary flame;

producing an inert hot gas flow by catalytic oxidation of an air/pilot fuel mixture, comprising catalytic oxidation in two separate stages, including a first stage comprising a POX-catalyst, including partially oxidizing an air/pilot fuel mixture with a mixture ratio $\lambda<1$ and thereafter leaning said air/pilot fuel mixture including admixing with air and feeding to a second stage comprising a FOX-catalyst as a leaned air/pilot fuel mixture with a mixture ratio $\lambda>1$, and completely oxidizing said leaned air/pilot fuel mixture in said second stage and issuing as an inert hot gas flow; and stabilizing the flame with the inert hot gas flow of at least 600° C., including introducing said inert hot gas flow into the combustion chamber in or adjacent to the flame.

12. The method as claimed in claim 11, comprising:

forming and feeding the air/pilot fuel mixture, for forming the inert hot gas flow, separately to the air/fuel mixture developing inside the burner volume.

13. The method as claimed in claim 11, wherein the air/pilot fuel mixture entering the POX-catalyst has an air/pilot fuel ratio $\lambda$ of $0.15 \leqq \lambda \leqq 0.4$ and wherein the partially oxidized air/pilot fuel mixture issuing from the POX-catalyst contains $CH_4$, $N_2$, $CO_2$, $H_2O$, and a syngas content of less than 5% volume and an $O_2$ content of less than 5% volume.

14. The method as claimed in claim 11, wherein the inert hot gas flow has a temperature between 600 °C. and 950° C. and consists essentially of $CO_2$, $H_2O$, $O_2$, and $N_2$.

15. The method as claimed in claim 11, comprising:

catalyzing the whole air-fuel mixture developing inside the burner volume to form the inert hot gas flow; thereafter mixing the inert hot gas flow with fuel; and igniting the inert hot gas flow and fuel to form the flame inside the combustion chamber.

16. The method as claimed in claim 13, wherein the syngas comprises $H_2$ and CO.

* * * * *